US005645270A

United States Patent [19]

Lawrence

[11] Patent Number: 5,645,270

[45] Date of Patent: Jul. 8, 1997

[54] PLASTIC COMPONENT CONNECTION SYSTEM

[76] Inventor: Lloyd L. Lawrence, 2050 W. 7th Ave., Denver, Colo. 80204

[21] Appl. No.: 667,594

[22] Filed: Jun. 24, 1996

[51] Int. Cl.[6] ..... E04H 17/14

[52] U.S. Cl. ..... 256/66; 256/65; 256/22; 256/19; 403/289; 403/291

[58] Field of Search ..... 256/19, 59, 65, 256/21, 66, 68, 24, 69, 1; 403/289, 291, 376, 290, 329

[56] References Cited

U.S. PATENT DOCUMENTS

| | | | |
|---|---|---|---|
| 350,127 | 10/1886 | Galloway . | |
| 2,249,381 | 7/1941 | Gustafson | 256/22 X |
| 2,859,469 | 11/1958 | Stockdale | 423/376 X |
| 3,471,182 | 10/1969 | Schroer | 256/65 X |
| 3,700,213 | 10/1972 | Blease . | |
| 3,720,401 | 3/1973 | Loch et al. . | |
| 3,822,053 | 7/1974 | Daily | 256/22 |
| 3,902,703 | 9/1975 | Bouye . | |
| 4,124,198 | 11/1978 | Wong . | |
| 4,357,000 | 11/1982 | Tisbo et al. . | |
| 4,477,058 | 10/1984 | Lowry . | |
| 4,553,741 | 11/1985 | Creasy et al. . | |
| 4,722,514 | 2/1988 | Pettit . | |
| 4,815,713 | 3/1989 | Schimanski . | |
| 4,854,548 | 8/1989 | Wylie . | |
| 5,078,367 | 1/1992 | Simpson et al. . | |
| 5,161,783 | 11/1992 | German | 256/19 |
| 5,215,290 | 6/1993 | Khalessi . | |
| 5,419,536 | 5/1995 | Bender . | |
| 5,421,556 | 6/1995 | Dodge et al. . | |
| 5,474,279 | 12/1995 | Parisien . | |
| 5,556,079 | 9/1996 | West | 256/22 |

FOREIGN PATENT DOCUMENTS

| | | | |
|---|---|---|---|
| 6322 | 1/1980 | European Pat. Off. | 256/65 |

*Primary Examiner*—Harry C. Kim

*Attorney, Agent, or Firm*—Ramon L. Pizarro; Edwin H. Crabtree

[57] ABSTRACT

A system for connecting plastic components wherein a plastic component includes a hollow female portion with a cavity having an inner surface. The system includes a hollow male portion with an inner cavity having an inner surface and at least two spaced apart sections, each spaced apart section having an opening through the section, the opening extending from the inner cavity to an external surface on the spaced apart sections. A resilient strip with at least one end adapted for frictional engagement with the inner surface of the hollow female portion, the end of the strip adapted for frictional engagement also being adapted for protrusion through the aperture in the spaced apart section the male portion, so that the end of the resilient strip adapted for providing frictional engagement extends through the opening and past the external surface on the spaced apart section the male section, so that when the spaced apart sections of said hollow male portion is inserted into the cavity of the female portion the end adapted for frictional engagement engages the inner surface of the hollow female portion to prevent separation of the parts.

13 Claims, 4 Drawing Sheets

PLASTIC COMPONENT CONNECTION SYSTEM

BACKGROUND OF THE INVENTION (a) Field of the Invention

This invention generally relates to field of devices for securing plastic components together, and more particularly, but not by way of limitation, to a system and method for connecting elements of plastic fence together.

(b) Discussion of the Prior Art

The advancement and development of modern plastic materials has allowed the substitution of an increasingly large number of materials with plastic materials. By substituting the material of manufacture to plastic one take advantage of the precision and efficiency of plastic molding processes.

As manufacturers seek more applications for plastics, the importance of understanding the properties of plastic materials becomes increasingly important since a straightforward substitution of plastic material for the traditional material is likely to result in an inefficient device which is likely to fail easily.

In recent years it has been recognized that plastic can be a durable, attractive substitute for wood in fencing applications. The ability of plastics, such as poly vinyl chloride or vinyl, to withstand the elements, as well as their ability to take on and hold popular colors, has prompted industry to recognize the need to provide quality plastic fence systems that make full use of the advantages of plastic materials. The marketplace, however, has repeatedly shown that it will not accept plastic items that do not look like items made from traditional materials. For example, with vinyl siding for houses, the challenge has been to produce durable plastic components that look like traditional wood board siding. Similarly, in the field of fencing, one of the key problems has been to provide plastic fence that looks like wood fence, but takes full advantage of the manufacturing and strength advantages of plastics.

In high volume manufacturing of plastic parts one generally tries to produce parts by means of extrusions or by means of molds. Extrusions use a die to continuously produce long parts with a desired constant cross-section. Molds are generally used produce individual pieces which contain features that do not allow manufacture of the part from extrusions. It is generally accepted that molds can be more expensive to manufacture than dies, and that the continuous fabrication of extrusions is more economical than the piecemeal fabrication accomplished by molding. However, molds can generally produce more precise parts than can be accomplished with extrusions. Thus it is advantageous to use extruded parts where tolerances are not critical since these can be significantly less expensive than molded parts. However, the mating of extruded parts to molded can pose problems due to the tolerances that must be taken into account when trying to match extruded parts.

In the field of fabrication of plastic fencing, for example, manufacturers have tried to keep the cost of fences down by using extruded sections where possible and molded parts where required. Thus, when providing plastic picket fencing it has been found that extruded sections have been used advantageously as plastic posts and plastic board or picket sections. However, these elements must include molded terminations and detailing that simulates wood picket fence, for example, in order to provide the same aesthetically pleasing effect as wood fencing. The combined use of extruded parts with molded parts has given rise to the need to devise an effective and economical system or method for joining molded and extruded parts, particularly parts for making fences.

One of the most common approaches at joining fence components has been to simply glue the components together. This approach, however, has some very serious drawbacks. Perhaps the most serious drawback being that the industrial glues and solvents used emit vapors that can pose serious health hazards to installers who are repeatedly exposed to the vapors while installing the fencing. Also, these glues do not dry instantly; therefore, the assembly process must be carefully coordinated in order to save time and achieve a quality product, without defects produced by shifting of the components while the glue cures. Moreover, the use of glues requires that the installer use care in not spilling or allowing the glue to run down the exposed areas of the fence. Still another disadvantage to glue is that it may not be practicable to correct a misplacement of parts once the adhesive cures.

In order to address the limitations of the use of adhesives, several attempts have been made at fabricating fence with the use of mating mechanical attachment means. Typically these attachments include integral spring tabs which bias pins or protrusions into recessions in a mating part. The field of plastic fabrication has typically taught the use of integral parts because of the economic advantages of incorporating several functions into a single part, which would reduce costs by requiring the manufacture of a single mold and obviate assembly steps.

Attempts at providing parts with mating mechanical attachment means have suffered from the tolerance requirements imposed by mating mechanical parts. For example, U.S. Pat. No. 5,421,556 to Dodge et al. teaches the use of a resilient cap with integral tab on an inside surface of the cap and which mates with a recession on an external surface of a post. An important limitation to this approach is the tolerances required for a quality, solid assembly. To join the assembly the integral tab must be positioned along the inner surface of the cap so that the tab reaches the recession when the cap is placed over the post. However, if too much distance is provided the cap will remain loose on the end of the post. If too little distance is allowed, the manufacturer runs the risk of providing caps that will not mate with the post, and thus result in wasted parts.

Other approaches, such as taught in U.S. Pat. No. 5,215,290 to Khalessi use external plastic components that reveal that the fence is plastic and not real wood, and thus are not aesthetically pleasing to many. Another approach taught in U.S. Pat. No. 4,553,741 to Creasy et al. uses slots in deformable plastic rails to interlock the rails in fabricating fence sections. This approach also suffers from the limitation that it easily detected as a plastic fence.

Other approaches, such as those taught in U.S. Pat. Nos. 4,477,058, 4,124,198, and 3,700,213 teach the use bulbous projections that are inserted into an orifice in the mating component. These approaches, however, require extensive use of molded parts, which do not take full advantage of the economical advantages of extruded parts.

Thus, there remains a need for a simple, secure system and method for joining sections of plastic fence so that the extrusions can be used where possible and molded parts used only where required. Moreover, there remains a need for an effective system and method for solidly joining components of fencing without the use of glues. Still further there remains a need for a strong system and method for joining plastic fence components that can be quickly installed with little need for special skills on the part of the assembly person.

SUMMARY

A system that addresses the above needs has been discovered, the system allows assembly of plastic fence components where at least one plastic fence component includes a hollow female portion with a cavity having an inner surface, the system includes the following elements:

a) a hollow male portion with an external surface which has an inner cavity with an inner surface, and at least two spaced apart sections. Each spaced apart section has an opening that extends through the section, from the inner surface of the cavity to the external surface of the spaced apart section;

b) a resilient strip with a first end and a second end, at least one of the ends having means for frictional engagement with the inner surface of the hollow female portion, the strip being adapted for insertion of the first end and the second end through the opening in at least one of the spaced apart sections, so that when the spaced apart sections of the hollow male portion is inserted into the cavity of the female portion the means for frictional engagement on the resilient strip engage the inner surface of the hollow female portion.

In a preferred embodiment at least one of the ends of the resilient strip includes at least one sharp protrusion that allows frictional engagement with the inner surface of the hollow female portion. It is also preferred that the resilient strip is made of stainless steel spring metal with a longitudinal cross section and sharp ends that include a sharp edge, or at least one pointed or serrated end. The longitudinal cross section of the resilient strip allows the strip to be inserted into the longitudinal openings in the hollow male portion in a manner that prevents rotation of the resilient strip. The strip should be inserted in a manner that allows the ends of the strip to extend or project from the external surface of the spaced apart sections of the hollow male portion.

By incorporating an arrangement that allows frictional engagement of the inside surface of the female portion one can achieve a joining system that can be used with extruded sections as well as with molded components. To join two extruded sections, a first and a second extruded section, each having a rectangular cross-section, one would simply cut out a longitudinal apertures near an end of the second extruded section to form the male portion. Thus, the second section, with the longitudinal apertures, will serve as the male portion once the resilient strip is inserted through the apertures. To join the two sections one would then simply insert the male portion into the female portion. As the male portion is inserted into the female portion the ends of the resilient strip will scrape against the inner surface of the female portion. The arched shape of the resilient band will allow the ends of the resilient band to slide into the female portion but will cause these ends to grip the inner surface of the female portion when the male portion is pulled in the opposite direction.

Thus according to another aspect of the invention, a method for connecting a first plastic component and a second plastic component has been discovered. The steps for the method include:

a) providing a first plastic component having a hollow female portion, the hollow female portion having a cavity having an inner surface;

b) providing a second plastic component having a hollow male portion with an inner cavity with an inner surface, an external surface, and at least two spaced apart sections, each spaced apart section having an opening therethrough, the opening extending from the inner surface of the cavity to the external surface of the spaced apart sections;

c) providing a resilient strip having first end and a second end, the first end and the second end of the resilient strip having means for frictional engagement with the inner surface of the hollow female portion;

d) inserting the first end and the second end of the resilient strip through the openings in the spaced apart sections of the second component, so that when the spaced apart sections of the hollow male portion is inserted into the cavity of the female portion the means for frictional engagement contact the inner surface of the hollow female portion and allow joining of the components.

Thus it will be understood by scientists, engineers, and those skilled in the art that the disclosed invention provides a system and method for assembling plastic components together, and particularly for joining sections of plastic fence without using glues, and for allowing the use of extruded sections together with molded sections, or even extruded sections together with extruded sections and molded sections with molded sections.

Importantly, the invention also solves problems associated with mating mechanical attachment components which can result in loose connections when tolerances are excessive or require the use of expensive, precisely positioned, mating parts so that looseness is avoided.

Also, it will be readily understood that the disclosed invention solves many of the problems associated with storage, contamination, and skill required with the use of glues or other chemical reactants to join plastic parts together.

Moreover, now with this summary it will become apparent that the disclosed invention is simple, inexpensive to manufacture, and very easy to install. The ease of installation, and the ability to use extruded sections with generally rectangular cross-sections which provide a nice, wood-like appearance are highly desirable and useful results that were not equally achievable with technology in the known prior art.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
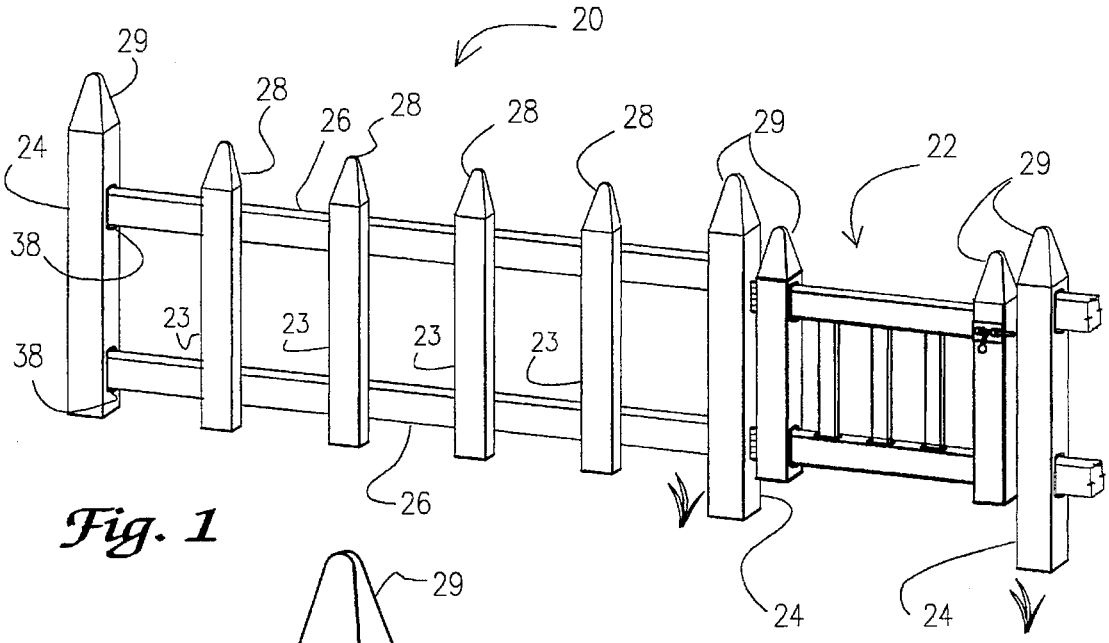
FIG. 1 illustrates a fence and gate assembly incorporating components connected according to the principles taught herein.
Figure 2:
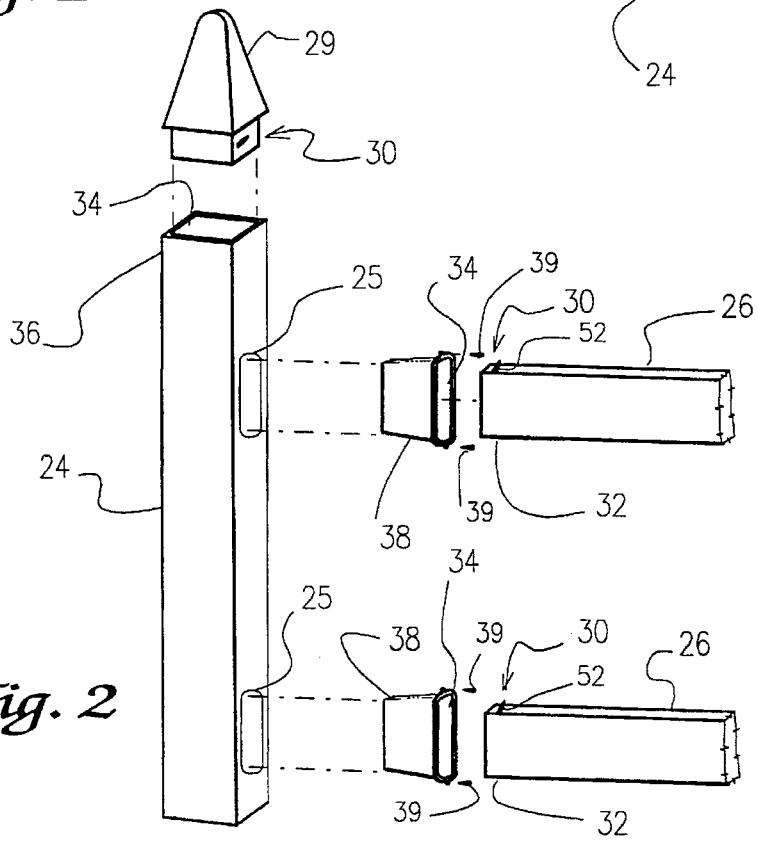
FIG. 2 is an exploded view illustrating the attachment of various sections together to form a basic fence assembly.

Turning now to FIG. 1, where a picket fence assembly 20 incorporating components connected according to the instant invention includes a gate 22, also assembled with the plastic component connection system 30 disclosed herein. Referring now to FIG. 2, which illustrates the use of the plastic component connection system 30 disclosed herein as used for the assembly of plastic fence components. As shown on FIGS. 1 and 2, sections of the picket fence assembly 20 can be formed by joining an extruded post 24 to long extruded rail sections referred to herein as stringers 26. Pickets 23 are attached to the rails or stringers 26 and include picket caps 28 mounted at an end to give the appearance of well known wood pickets. On top of the extruded post 24 is a post cap 29; the post cap 29 as well as the picket caps 28 incorporate the plastic component connection system 30. Similarly, the stringer 26 includes the plastic component connection system 30 near an end 32 of the stringer 26.

As has been illustrated in FIG. 2, the plastic component connection system 30 includes a portion that is insertable into a hollow female portion 34, which when using the invention to connect the cap 28 to the extruded post 24, the end 36 of the extruded post 24 provides the hollow female portion 34 for the plastic component connection system 30.

Similarly, when attaching the stringer 26 to the extruded post 24 a molded pocket 38 is inserted into a cutout 25 in a side of the post 24, and fastened in place with screws 39. The pocket 38 also includes a hollow female portion 34 which can accept the end 32 of the stringer 26. The end 32 of the stringer 26 includes the plastic component connection system 30.

Figure 5:
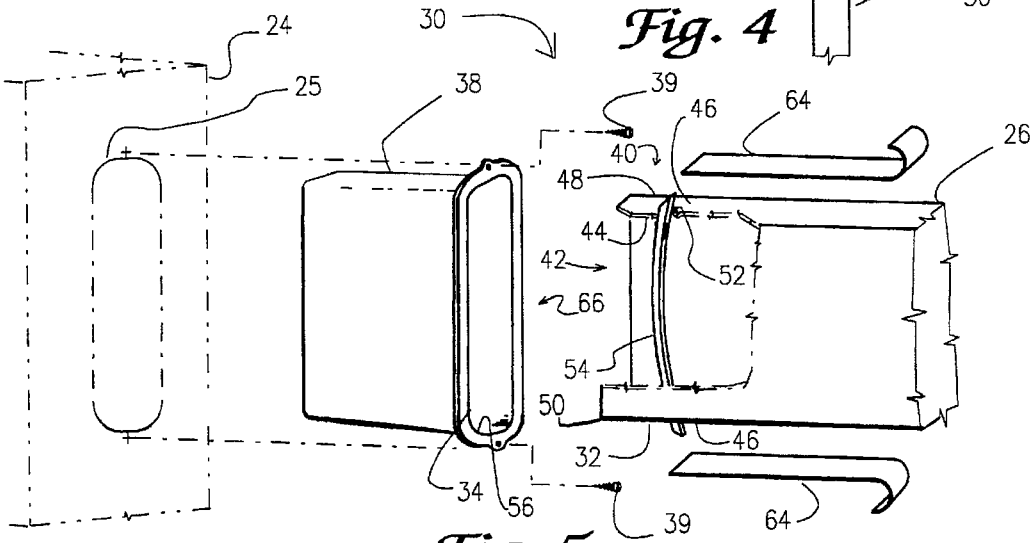
FIG. 5 is an exploded view including the system used to connect two extruded posts together.
Figure 5A:
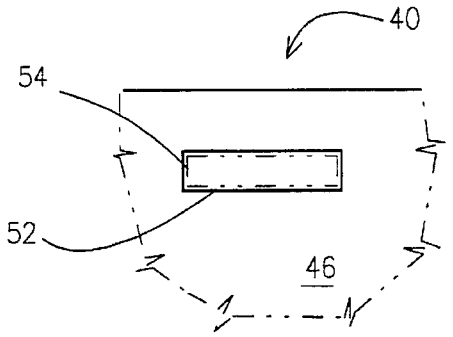
FIG. 5A is a detail view of longitudinal opening adapted for receiving the resilient strip.

Referring now to FIG. 5, which shows an exploded view of the pocket 38, together with the end 32 of the stringer 26. The end 32 of the stringer 36 has been shown with a portion being cut away to reveal details of the plastic component connection system 30. As is shown in FIG. 5, the plastic component connection system 30 includes a hollow male portion 40 at the end 32 of the stringer 26. The hollow male portion 40 includes an inner cavity 42 with an inner surface 44 and an external surface 46. The male portion 40 also includes at least two spaced apart sections, which include a first section 48 and a second section 50. Each of the spaced apart sections has an opening, which is preferably a longitudinal opening 52, as detailed in FIG. 5A, which extends from the inner surface 44 through to the external surface 46 of the spaced apart sections of the male portion 40.

The male portion 40 accepts a resilient strip 54 which is preferably arched shaped and placed through the two longitudinal openings 52, so that the ends 58 of the resilient strip 54 protrude from the male portion 40 as shown on FIG. 5. Thus the resilient strip 54 serves as a retention means for providing the bias needed for establishing effective frictional engagement with an inner surface 56 of the female portion 34 of the pocket 38. As used herein, the term "frictional engagement" is not intended to refer to mechanisms of the type which include a pin or projection and a hole for receiving the pin or projection, where the retention strength is determined by the shear strength of the pin or projection cross-section. The term "frictional engagement" is intended to include engagement force produced from friction, as where gouging, scraping, or pressing occurs against a surface with relatively soft surface hardness as found in plastics and other soft materials as compared to most steels or other comparable metals, as well as where engagement is achieved through the product of a high frictional coefficient and a normal force.

Figure 7:
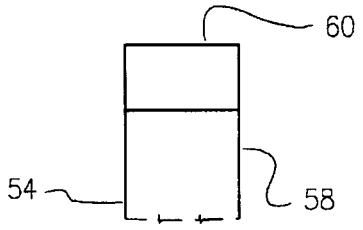
FIG. 7 is a plan view of the means for frictional engagement incorporated in the ends of the resilient strips, the illustrated embodiment being a sharp edge.
Figure 8:
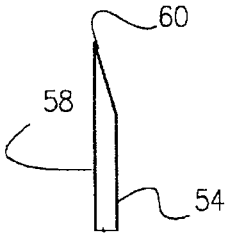
FIG. 8 is a side view of the embodiment shown on FIG. 7.
Figure 9:
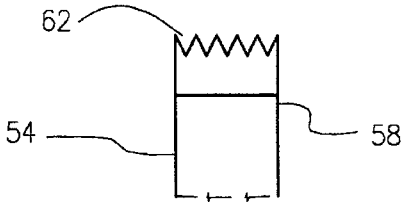
FIG. 9 is a plan view of an embodiment of the means for frictional engagement incorporated in the ends of the resilient strips, the illustrated embodiment being a serrated edge.

Thus when the resilient strip 54 provides frictional engagement with an inner surface 56 of the female portion 34 a first end 58 of the resilient strip 54 scrapes, gouges and presses against the inner surface 56 of the hollow female portion 34. It can be appreciated that to effect the frictional engagement one may incorporate a sharp edge 60 as shown on FIGS. 7 and 8 at the end 58 of the resilient strip 54. Alternatively, a serrated edge 62 may be incorporated at the end 58 of the resilient strip 54.

In a highly preferred embodiment the resilient strip 54 also includes a second end 58 which also includes a sharp edge 60, a serrated edge 62, or other means for providing frictional engagement between the resilient strip 54 and the inner surface 56 of the female portion.

Figure 3:
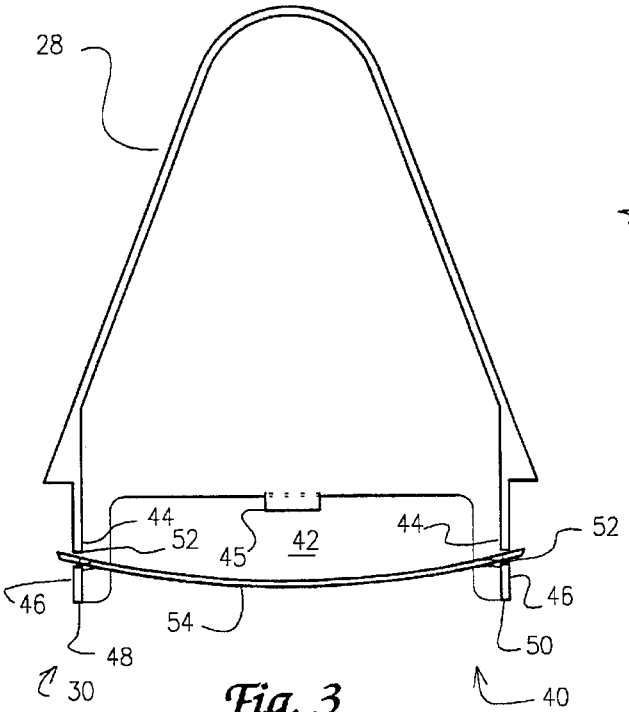
FIG. 3 is a side sectional view of a molded fence post cap including an attachment system in accordance with the principles of the disclosed invention.
Figure 4:
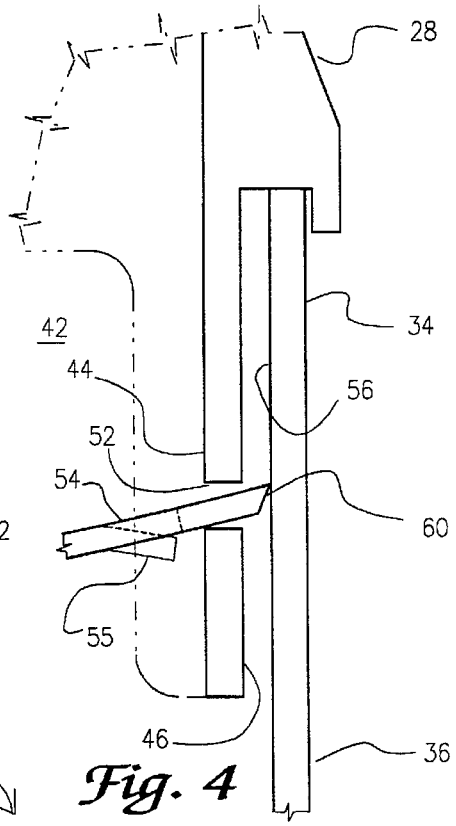
FIG. 4 is an enlarged side sectional view of a fence post cap with the disclosed attachment system, the illustrated system shown engaging the inner surface of a female portion.

Referring now to FIGS. 3 and 4, from which it will be understood that it is preferred that the opening 52 in the spaced apart sections 50 of the hollow male portion 40 be longitudinal or slotted in shape. An important advantage of a slotted shape is that it can prevent the twisting or turning of a resilient strip 54 inserted therethrough. It is desirable to keep the resilient strip 54 from twisting or turning in order to maintain the generally arched shape of the resilient strip 54. The orientation of the arch should be such that the convex surface of the resilient strip 54 is faces the direction of insertion of the male portion 40 into the female portion 34. This arrangement will impose a bias on the end 58 of the resilient strip 54 which will cause the sharp edge 60, serrated edge 62 or other frictional means to engage the inner surface 56 of the female portion 34.

Additionally, by placing the convex surface of the resilient strip 54 in the direction of insertion one imposes a self-energizing action, analogous to the self-energizing action found in self-energizing brakes, on the bias of the ends of the resilient strip 54 as the male portion 40 is pulled out of the female portion. This self-energizing action allows the exertion of a force which presses the end 58 of the resilient strip 54 against the inner surface 56 of the female portion in proportion to the force used to try to pull the male portion 40 out from the female portion. Thus it is to be understood that this self-energizing action may also be achieved by fixing one end of a resilient strip to the inner surface 44 of the hollow male portion 40 and allowing the other end of the resilient strip to be biased against the inner surface of the female portion in a barb-like fashion; however, the preferred embodiment greatly simplifies and improves on this type of arrangement.

Figure 6:
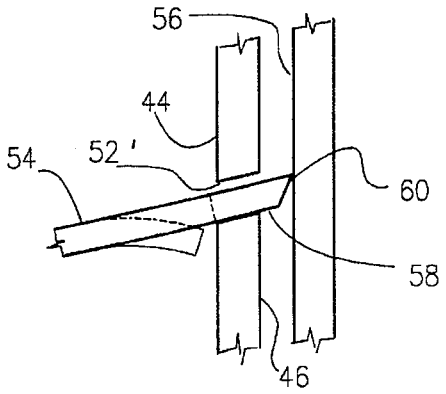
FIG. 6 is a detailed sectional side view showing a male portion within a female portion, the male portion having a slanted opening for accepting the resilient strip.

As has been shown in FIG. 6 the opening 52' in the male portion may be include a slight angle which would aid in maintaining the arched shape of the resilient strip 54. Also, it is contemplated that this angled aperture will lend greater support to the resilient strip 54, and thus provide desirable gripping characteristics. However, it is contemplated that for most applications this angle in the aperture will not be needed. Since it is contemplated that difficulties associated with manufacturing this angle will generally outweigh the benefits of incorporating the angle.

It is preferred that the resilient strip 54 be made from stainless steel or another corrosion resistant resilient material. As explained above, the resiliency is required in order to bias the ends 58 of the strip 54 against the inner surface 56 of the female portion. Also, since it is contemplated that the plastic component connection system 30 will be used primarily outdoors, it is highly desirable to fabricate all components of corrosion resistant materials in order to prevent staining of the fence materials.

The plastic component connection system 30 according to the principles disclosed herein may also be used as part of a fence picket cap 28 as has been shown in detail on FIGS. 3 and 4. In the embodiment illustrated in FIG. 3, the resilient strip 54 resides in the hollow male portion 40 with the inner cavity 42 bounded by the first spaced apart section 48 and a second spaced apart section 50. The first spaced apart section 48 and the second spaced apart section 50 of the hollow male portion 40 each having an inner surface 44 and an external surface 46. Also shown on FIG. 3 is an alignment tab 45, which serves to guide and hold the sides of the female portion 34 in a desired relationship to the hollow male portion 40. It is desirable to include the alignment tab 45 in order to facilitate assembly since the female portion 34 may be bowed-in or out of tolerance in the case where an extrusion is used.

As shown on FIGS. 1–2 and 4, the male portion 40 of the cap 28 may be inserted into end 36 of the post, allowing the means for frictional engagement of the ends 58 of the resilient strip 54 to be biased against the inner surface 56 of the end 36 of the post 24 once the male portion 40 has been inserted into the female portion 34 of the post 24.

Figure 10:
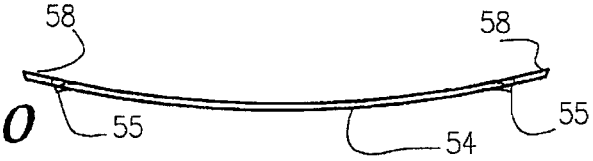
FIG. 10 is a side view of a resilient strip, the resilient strip including means for retaining the resilient strip within the cavity of the male portion.
Figure 11:
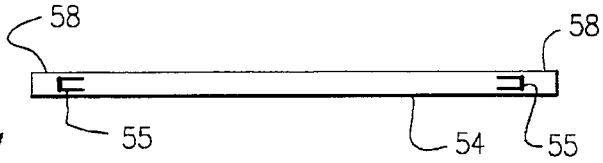
FIG. 11 is a plan view of the resilient strip shown on FIG. 10.
Figure 12:
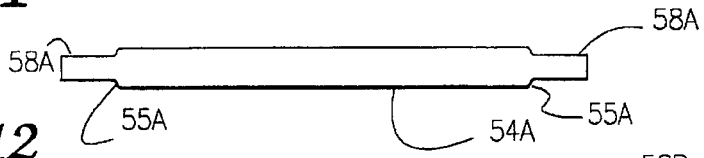
FIG. 12 is a plan view of a resilient strip, the resilient strip including an alternative means for retaining the resilient strip within the cavity of the male portion.
Figure 13:
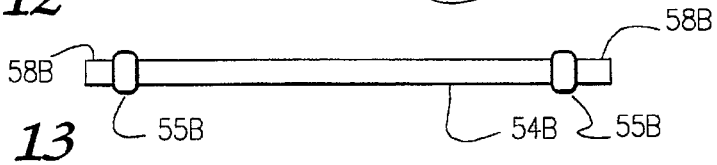
FIG. 13 is a plan view of a resilient strip, the resilient strip including an alternative means for retaining the resilient strip within the cavity of the male portion.

Referring now to FIGS. 10 and 11 it can be seen that in a highly preferred embodiment of the invention the resilient strip 54 includes upset tabs 55 near the ends 58. The upset tabs 55 serve as tab means for preventing the straightening and falling out of the resilient strip 54 from the openings 52 in the hollow male portion 40. It is contemplated, as shown on FIG. 12, that this function may be performed by including narrow sections near the ends 58A of the resilient strip 54A. Additionally, as shown on FIG. 13, the function of the upset tabs 55 may also be achieved by incorporating broad protrusions 55B near the ends 58B of the resilient strip 54B. These protrusions 55B may be made by attaching a plastic bead to the resilient strip 54B, or by inserting a rivet or the like through the resilient strip 54B.

It is important to include retention means such as the upset tabs 55 in order to ensure that the arch and position of the resilient strip is maintained during shipping of parts containing the invention to the installer. Also, the retention means will facilitate installations where the resilient strips 54 will assume a generally vertical orientation prior to being installed.

Figure 14:
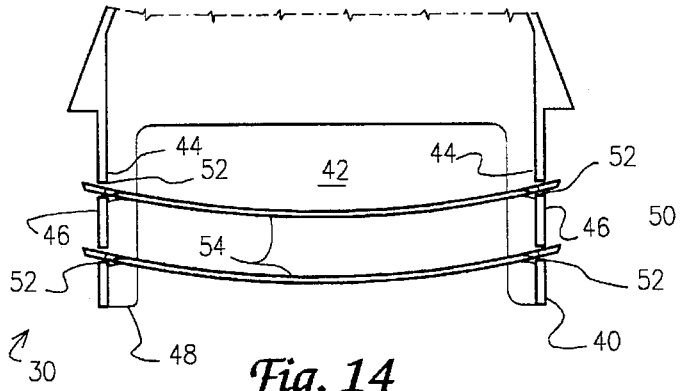
FIG. 14 is a side sectional view of a molded cap including a pair of resilient strips being used to provide enhanced retention strength.
Figure 15:
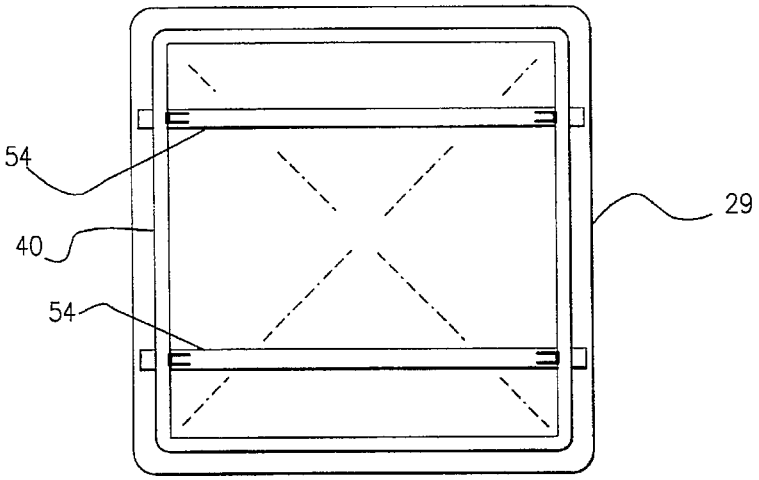
FIG. 15 is a view looking up at the inside of a post cap, the post cap including a pair of resilient strips arranged side to side.

Referring now to FIG. 14, where it has been illustrated that it is contemplated that the system as described herein allows the use of more than one resilient strip 54 with the elements to be connected in order to increase the strength of the connection. While the use of multiple resilient strips 54 has been illustrated as being in tandem fashion in FIG. 14. As shown in FIG. 15 the system may also be used with side-by-side configuration of resilient strips 54 in a fence post cap 68, for example. Thus, multiple resilient strips 54 may be installed side by side, in tandem, or in another suitable arrangement within the male portion in order to increase the strength of the connection.

Figure 16:
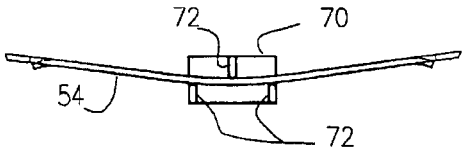
FIG. 16 illustrates a curvature setting element that may be used with the resilient strips in order to ensure retention of a predetermined arch in the resilient strip.
Figure 17:
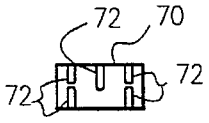
FIG. 17 is an embodiment of a curvature setting element that may be used with the resilient strips in order to ensure retention of a predetermined arch in the resilient strip.
Figure 19:
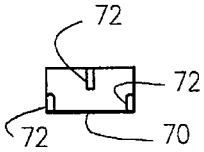
FIG. 19 illustrates the curvature setting element shown on FIG. 16, without the resilient strip.
Figure 18:
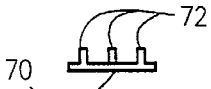
FIG. 18 is a side view of the curvature setting element shown on FIG. 17.

Additionally, as shown on FIGS. 16–18, it is contemplated that a curvature setting element 70 which serves to hold the desired curvature of the resilient strip 54. The curvature setting element is preferably made of a plastic material, and includes at least three protrusions 72 that hold and curve the resilient strip 54. In a preferred embodiment of the curvature setting element 70, illustrated in FIG. 17, two pairs of protrusions 72 are spaced apart and used to retain the resilient strip 54 on the curvature setting element 70. A fifth protrusion 72 is placed between the two pairs of protrusions 72 and establishes a curvature on the resilient strip 54.

It is particularly advantageous to use a curvature setting element 70 when using the system in applications where there is a possibility of having the resilient strip 54 assume a bend that is in a direction that is opposite to the bend required for achieving the self energizing effect discussed above. Also, it is contemplated that by installing the curvature setting element 70 on the resilient strip 54 one may ensure that the proper curvature of the resilient strip is not lost during shipping, for example.

Therefore it can be appreciated that disclosed invention 30 allows the assembly of plastic fence assemblies 20 and plastic gate assemblies 22 by combining a few molded parts, such as the caps 28 and the pockets 28, and extruded sections, such as the posts 24 and the stringers 26. The assembly of these components is achievable without the use of glue or solvents.

The insertion of the male portion 40 into the female portion 34 may be facilitated by placing a pair of shields 64, which may be made from a thin, hard metal material, such as metal shim stock, between the protruding ends 58 of the resilient strip 54 and the inner surface 56 of the female portion 34. The shields 64 will hold the ends 58 of the resilient strip 54 down as the male portion 40 is slipped into the female portion 34. Once the parts are in a desired position relative to one another, the shields 64 may then slipped out from between the ends 58 of the resilient strip 54 and the inner surface 56 of the female portion 34 causing engagement of the means for frictional engagement.

Thus according to yet another aspect of the invention a method for connecting a first plastic fence component and a second plastic fence component has been disclosed. The method comprises the steps of providing a first plastic fence component having a hollow female portion 34, the hollow female portion 34 having a cavity 66 that includes the inner surface 56 of the hollow female portion 34. Then providing a second plastic fence component having a hollow male portion 40 with an inner cavity 42 with an inner surface 44, an external surface 46, and at least two spaced apart sections, each spaced apart section having a longitudinal opening 52 therethrough, the opening 52 extending from the inner cavity 42 to the external surface 46 of the spaced apart sections. Then providing a resilient strip 54 having ends 58, the ends of the resilient strip having means for frictional engagement with the inner surface 56 of the hollow female portion.

Then inserting the ends 58 of the resilient strip 54 through the longitudinal openings 52 in the first spaced apart section 48 and second spaced apart section 50, so that when the spaced apart sections 48 and 50 are inserted into the cavity of the female portion 34 the means for frictional engagement engage the inner surface 56 of the hollow female portion 34.

It can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A system for connecting at least two components wherein one component includes a hollow female portion having a cavity with an inner surface, the system comprising:

a male portion having at least two spaced apart sections, the spaced apart sections defining a cavity therebetween, each spaced apart section having an opening therethrough;

at least one retention means comprising an elongate resilient body having at least two ends adapted for insertion through the openings in the spaced apart sections, the resilient body further having at least one protrusion near each of the ends, the protrusions being adapted for limiting the insertion of the ends of the retention means through the opening in one of the spaced apart section, such that the insertion of one end of the retention means through the opening in one spaced apart section and the other end of the retention means through the opening in another spaced apart section pretensions the retention means such that the retention means assumes a generally arched shape prior to insertion of the male portion into the female portion, so that the insertion of the male portion into the female portion allows the retention means to flex within the cavity of the male portion, biasing the ends of the retention means against the inner surface of the female portion.

2. A system according to claim 1, wherein the protrusions of said retention means comprise an upset section of material.

3. A system according to claim 2, and further comprising a curvature setting means comprising a substantially planar body having protrusions arranged to define a nonlinear space therebetween, such that insertion of the retention means within the non linear space reinforces the curvature and pretension on the retention means.

4. A system according to claim 3, wherein said retention means comprises a metallic band.

5. A system for connecting plastic components according to claim 4, wherein the opening in each spaced apart section defining a cavity is generally slotted in shape.

6. A system according to claim 5, wherein the ends of said retention means include at least one sharp edge.

7. A system for connecting at least two components wherein one component includes a female portion having a cavity with a plastic inner surface, the system comprising:

a male portion having at least two spaced apart sections, the spaced apart sections defining a cavity therebetween, each spaced apart section having an opening therethrough;

at least one retention means comprising an elongate resilient body of a length that is greater than the distance between the spaced apart sections and having at least two ends, each end being adapted for insertion through the openings in the spaced apart sections; and a curvature setting means comprising a substantially planar body having protrusions arranged to define a nonlinear space adapted for receiving said retention means therebetween, so that insertion of the retention means within the non linear space arches and pretensions the retention means, so that after insertion of one end of the retention means through the opening in one spaced apart section and the other end of the retention means through the opening in another spaced apart section of the retention means the pretensioned retention means may be inserted into the female portion, so that upon the insertion of the male portion into the female portion the ends of the retention means engage the inner surface of the female portion through the openings in the spaced apart sections and thereby causing the retention means to arch further within the cavity of the male portion to further bias the ends of the retention means against the inner surface of the female portion.

8. A system according to claim 7, wherein said retention means includes at least one protrusion near each end.

9. A system according to claim 7, wherein the spaced apart sections are spaced apart so as to extend in a parallel manner to and proximate to the inner surface of the cavity in the female portion when inserted into the female portion.

10. A system for connecting at least two components of plastic fence, the system comprising:

at least one element containing a hollow female portion having a cavity with a plastic inner surface;

at least one component including a male portion having at least two spaced apart sections, the spaced apart sections being adapted for fitting within the cavity of the female portion within close proximity to the plastic inner surface of the female portion, the spaced apart sections defining a cavity therebetween, and each spaced apart section having an opening therethrough;

at least one retention means comprising an elongate resilient body of a length that is greater than the distance between the spaced apart sections and having at least two ends, each end being adapted for insertion through the openings in the spaced apart sections, each end further having at least one protrusion, the protrusion being adapted for limiting the insertion of the end of the retention means through the opening of the spaced apart sections, so that the insertion of one end of the retention means through the opening in one spaced apart section and the other end of the retention means is inserted in the opening in another spaced apart section pretensions the retention means assumes a generally arched shape prior to insertion of the male portion into the female portion, so that the insertion of the male portion into the female portion allows the retention means to flex within the cavity of the male portion, biasing the ends of the retention means against the inner surface of the female portion.

11. A system according to claim 10, and further comprising a curvature setting means comprising a substantially planar body having protrusions arranged to define a nonlinear space therebetween, such that insertion of the retention means within the non linear space reinforces the curvature and pretension on the retention means.

12. A system according to claim 10, wherein said hollow female portion comprises a pocket element having means for attachment to a fence section.

13. A system according to claim 12, wherein the protrusions of said retention means comprise an upset section of material.

* * * * *